United States Patent [19]

Zernig

[11] 4,197,612

[45] Apr. 15, 1980

[54] CABINET HINGE

[75] Inventor: Ernst Zernig, Hemer, Fed. Rep. of Germany

[73] Assignee: Firma Richard Heinze GmbH & Co, KG, Fed. Rep. of Germany

[21] Appl. No.: 905,526

[22] Filed: May 12, 1978

[30] Foreign Application Priority Data

May 13, 1977 [DE] Fed. Rep. of Germany ... 7715244[U]

[51] Int. Cl.[2] ..... E05D 5/12

[52] U.S. Cl. ..... 16/183; 16/169

[58] Field of Search ..... 16/180, 181, 182, 183, 16/169, 145, 163, 164, 168, 169

[56] References Cited

U.S. PATENT DOCUMENTS 2,924,843 2/1960 Tykeson ..... 16/182

FOREIGN PATENT DOCUMENTS 2053315 5/1972 Fed. Rep. of Germany ..... 16/180
2505527 8/1976 Fed. Rep. of Germany ..... 16/180
2541144 3/1977 Fed. Rep. of Germany ..... 16/180

*Primary Examiner*—George H. Krizmanich
*Attorney, Agent, or Firm*—Jacobs & Jacobs

[57] ABSTRACT

This invention relates to a cabinet hinge for the hinged connection of two cabinet parts, having two hinge parts each adapted to be fastened to one of the cabinet parts and pivotally connected with each other by a hinge system, and having an additional spring element, for instance a leaf spring. This spring element produces a holding or snapping action and it is fastened at each end to one of the hinge parts. In order to facilitate the mounting of the pretensioned spring element, a bearing body is provided to hold the spring element on at least one of the two hinge parts.

7 Claims, 6 Drawing Figures

(II-II)

(I-I)

CABINET HINGE

The present invention relates to a cabinet hinge for the pivoted connecting of two cabinet parts, having a first hinge part which is adapted to be fastened to the one cabinet part, for instance the cabinet body, and having a second hinge part adapted to be fastened to the other cabinet part, for instance the cabinet door, as well as an articulation system connecting the hinge parts and preferably having four hinge pins and four hinge levers, and also having a spring element for producing a holding or snapping action, the spring element being fastened at one end to the first hinge part and at the other end to the second hinge part.

Cabinet hinges of this type are in themselves known and serve, for instance, for the attachment of cabinet doors which in closed condition rest tightly against the front surface of a cabinet, the spring element insuring that upon the closing of the cabinet door the spring element is increasingly tensioned in order to produce the spring force and that just before the closed-door position is reached it can again relax, giving off its spring force. In this way, at the end of the closing movement the door is automatically pressed by the spring element into the closed position and held fast there.

Certain difficulties exist in connection with cabinet hinges of this type in mounting the spring element, for instance the leaf spring used as spring element, since the spring element must be mounted in partially tensioned condition, for instance with the cabinet hinge completely open. Only in this way is depenable operation of the mounted hinge possible, i.e. only in this way can assurance be had that sufficient holding action on the part of the spring element is obtained particularly in the closed-door position, and that the spring element is held dependably on both hinge parts during every phase of movement of the hinge.

The object of the present invention is to develop a furniture hinge of the type described above in such a manner that the mounting of even a pretensioned spring element is substantially facilitated.

In order to achieve this purpose, a cabinet hinge of the aforementioned type is so developed in accordance with the invention that for the holding of the spring element on at least one hinge part there is provided a bearing body to which the end of the spring element is fastened and which is fastened to the hinge part by means of a pin which engages in a borehole of the bearing body as well as in a borehole of said hinge part, that a first resting surface is provided on the bearing body at a first distance from the borehole in the bearing body and a second resting surface is provided on the hinge part at a second distance from the borehole in said hinge part, and that the difference between said distances is less than the diameter of the boreholes.

With this construction it is possible, upon the mounting of a cabinet hinge, first of all temporarily to fix the pretensioned spring element (for instance leaf spring) by the resting of the first resting surface of the bearing body against the second resting surface of the hinge part, whereby the pin can then be introduced into the borehole for the final fastening of the bearing body to the hinge part. Since the difference between the distances of the first and second resting surfaces from the corresponding borehole in the bearing body and the hinge part respectively is smaller than the diameter of these boreholes, assurance is also had upon the temporary fixing of the spring element by the resting surfaces that the said boreholes will at least partially coincide even while the pin is still not inserted, so that the pin can easily be inserted into the boreholes. Upon this insertion, the bearing body is moved relative to the hinge part in such a manner that the borehole in the bearing body, with the pin inserted, coincides with the boreholes in the hinge part. Of course, it is also possible in this connection to develop the spring element or the resting surfaces in such a manner that the spring element is without tension or only slightly tensioned when the pin is not yet mounted, the final desired pretensioning of the spring element then being effected by displacement of the bearing body relative to the hinge part upon the introduction of the pin. The mounting of this pin is effected preferably with the cabinet hinge entirely open, since the spring element as a rule has the least tension in this condition of the hinge.

In a preferred embodiment of the cabinet hinge of the invention, the bearing body consists of a sleeve having a continuous borehole, this sleeve having on one or both ends a section of increased cross section the circumferential surface of which forms the first resting surface. This bearing body developed as sleeve is then at least partially surrounded in the region thereof outside the portion of the larger cross section by one end of the spring element or of the leaf spring serving as spring element.

In the cabinet hinge of the invention the bearing body is preferably provided on the first hinge part, for instance on the hinge part to be fastened to the cabinet body, and, when using a hinge arm of U-shaped cross section as first hinge part and a bearing body developed as sleeve, this sleeve is supported on the sides of the U-shaped hinge arm and has a length which corresponds approximately to the distance between the inner surfaces of said sides so that the sleeve whose ends rest against the inner surfaces of the sides is secured against undesired tilting upon the introduction of the pin into the space between the sides.

The invention will be explained in further detail below on an illustrative embodiment, referring to the drawing, in which.

Figure 1:
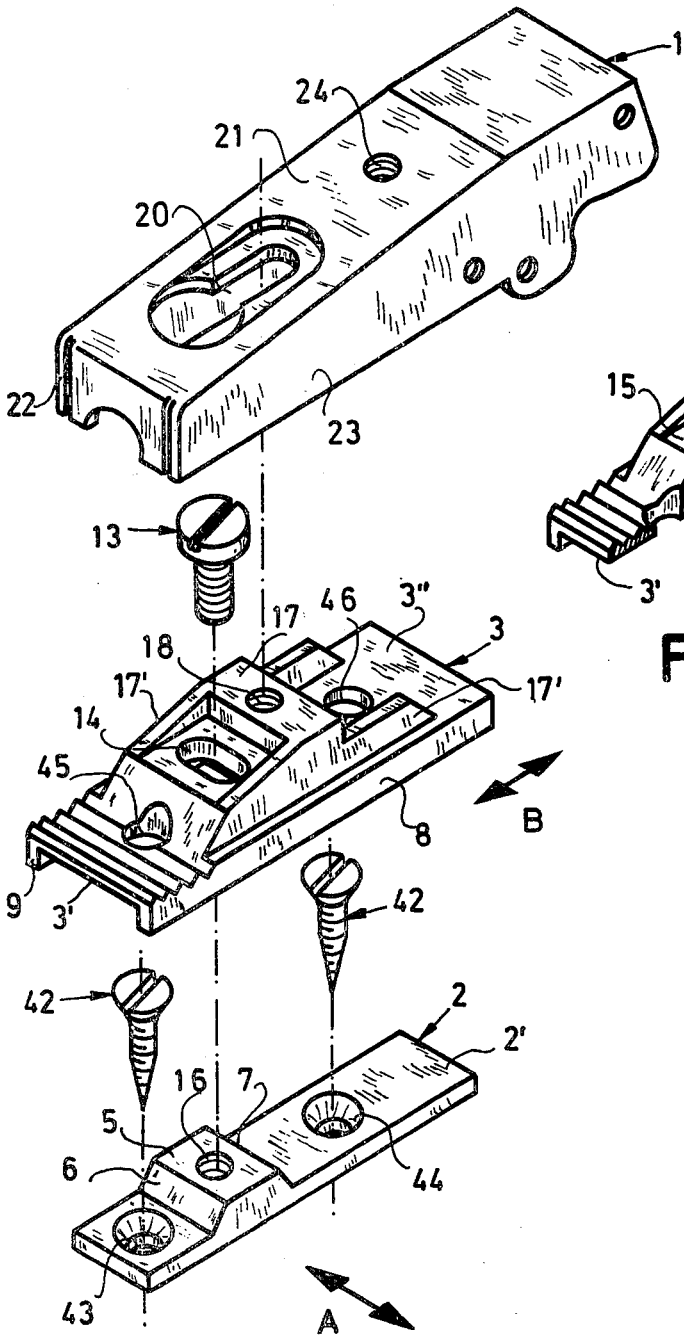
FIG. 1 is an exploded view in perspective of a hinge arm of a cabinet hinge together with a base or adjustment plate consisting of a carrier and an intermediate carrier, in the case of a hinge in accordance with the invention.
Figure 2:
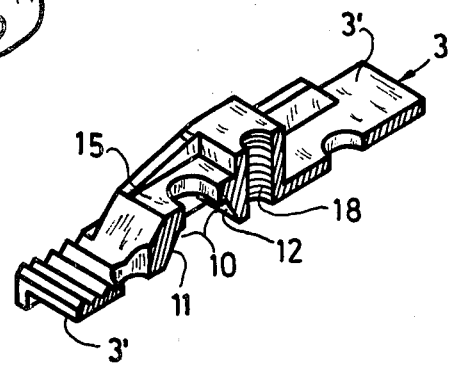
FIG. 2 is a perspective view of the carrier or bearing element of the base or adjustment plate of FIG. 1, cut in longitudinal direction.

In the figures, 1 is a hinge arm of U-shaped cross section which can be fastened to a cabinet side wall 4, in a manner adjustable along three axes in space which are perpendicular to each other, by means of a base or adjustment plate which consists of the intermediate carrier 2 and the bearing element or carrier 3. In the embodiment shown, the intermediate carrier 2 as well as the bearing element 3 are both developed in plate shape, the intermediate carrier 2 having on the topside 2' thereof which faces away from the surface of the cabinet wall 4 when the hinge is fastened, an extension 5 which extends over the entire width of the rectangular intermediate carrier 3 and has a trapezoidal cross section in the direction perpendicular to the longitudinal axis of said intermediate carrier, i.e. in the direction indicated by the double-ended arrow A, the extension 5, starting from the topside 2' of the intermediate carrier 2, tapering towards its free end and having on each of the sides facing the ends of the intermediate carrier 2 lateral guide surface, 6 and 7 respectively, which are oblique to the topside 2' and extend in the direction of the double-ended arrow A.

The carrier or the bearing element 3 is developed on its bottom 3' in U-shape with legs 8 and 9 protruding perpendicularly from said bottom and has on this bottom side which faces the topside 2' of the intermediate carrier 2 a recess 10 which corresponds to the extension 5 and also extends in the direction indicated by the double-armed arrow A and narrows down in trapezoidal shape starting from the bottom side 3' so as to form lateral guide surfaces 11 and 12 extending obliquely to the bottom side 3'. The distance apart of the legs 8 and 9 of the bearing element 3 is greater than the width of the intermediate carrier 2 so that the bearing element 3 can be displaced in the direction indicated by the double-ended arrow A on the intermediate carrier 2 which is arranged almost invisibly between the legs 8 and 9 and extends via its extension 5 into the recess by a certain amount (difference between the distance between the legs 8 and 9 and the width of the intermediate carrier 2). In order to fasten the bearing element 3 to the intermediate carrier there is used a screw 13 which extends through a slot 14, extending in the direction indicated by the double-ended arrow A and located in the region of the bottom 15 of the recess 10, into a thread 16 in the extension 15, while its head rests against the side of the bottom 15 which faces away from the recess 10.

In order to be able to provide the recess on the bottom side 3 even in case of a relatively thin development of the bearing element 3, the bearing element 3 is provided on its top side 3" with an elevation 17 of substantially step-shaped course, the recess 10 being located below the region of lower height of said elevation 17 while within the region of larger height there is provided a thread 18 for a holding screw 19 which engages, through a keyhole-shaped recess 20 in the yoke surface 21 of the hinge arm 1, into the thread 18 and serves to hold the hinge arm 1 against the bearing element 3.

The width of the elevation 17 is less than the width of the rest of the bearing element 3 and corresponds approximately to the distance between the inner side of the sides 22 and 23 of the hinge arm which extend perpendicular to the yoke surface 21 so that the longitudinal sides 17' of the elevation 17 which extend perpendicular to the double-ended arrow A form guide surfaces for the hinge arm 1 or its sides 22 and 23 and permit displacement of the hinge arm 1 in the longitudinal direction of the bearing element 3 or in the direction indicated by the double-ended arrow B. In order to obtain at the same time also an adjustment of the hinge arm in the direction perpendicular to the surface of the cabinet wall 4, i.e. in the direction indicated by the double-ended arrow C, a thread 24 is provided in known manner in the yoke surface 21 of the hinge arm 1 for an adjustment screw 25, the lower end of which forms an adjustable stop surface, resting against the top 3" of the bearing element 3, for the hinge arm.

In the sides 22 and 23 there are supported, at one end of the hinge arm 1, pivot pins 26 and 27 to each of which there is pivoted one end of a hinge lever 28 and 29 respectively, the other ends of which are pivotally connected via hinge pins 30 and 31 with a hinge housing 32 which can be fastened in a recess of a cabinet door (not shown in detail).

Figure 3:
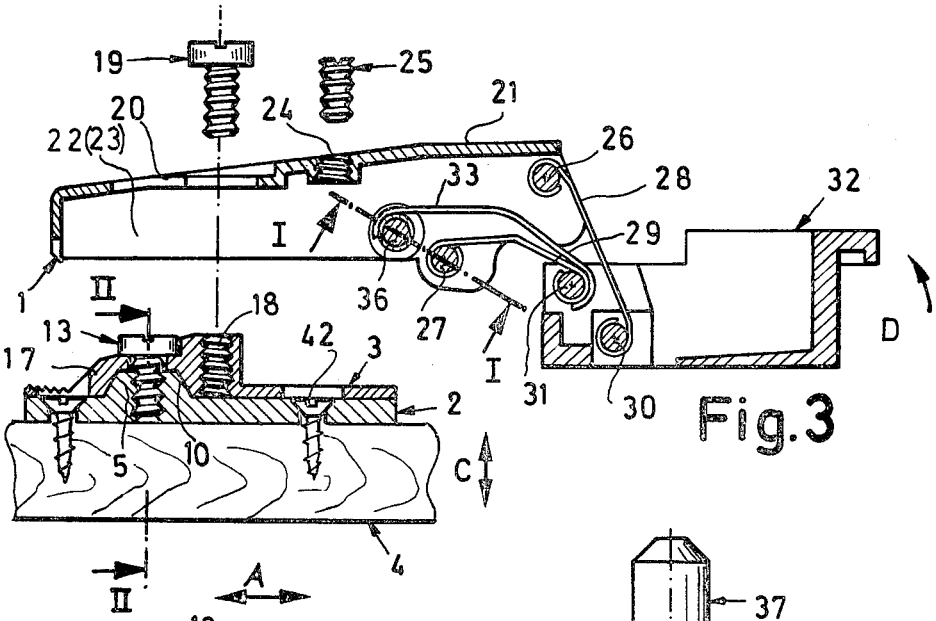
FIG. 3 is a longitudinal section through the entire hinge of the invention, the hinge arm being removed from the base or adjustment plate which is to be fastened to a cabinet side wall.
Figure 4:
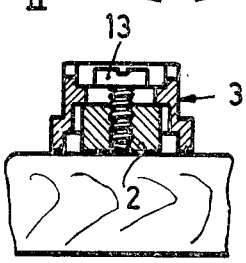
FIG. 4 is a section along the line II—II of FIG. 3.
Figure 6:
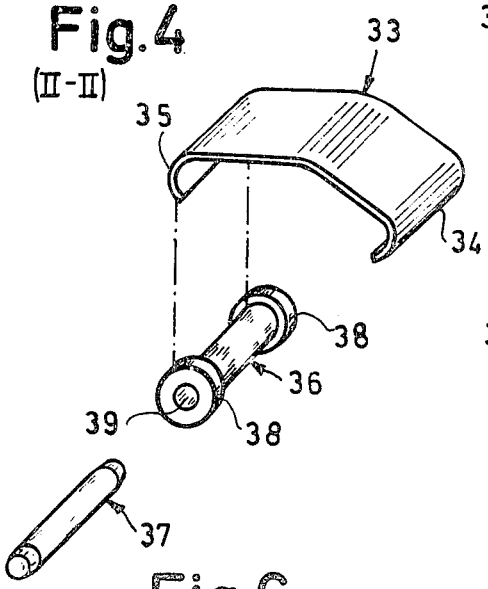
FIG. 6 shows in a detailed perspective view a spring element, developed as leaf spring, for use in the hinge of FIGS. 1 to 5, together with a bearing sleeve for the spring element.

FIG. 3 shows the position of the hinge housing 2 in the door-open position. Upon the closing of the door, the hinge housing 33 is swung, in the direction of the arrow D, into a position which is 90° away from the position shown in FIG. 3. In order now, upon the closing of the cabinet door which is connected with the hinge housing 32, to obtain, at least at the end of the closing movement, an automatic, complete closing of the cabinet door and furthermore hold the door fast in the closed position so that it can be opened again only after a given force has been overcome, a curved leaf spring 33 is provided. It has its partially rolled end 34 attached to the hinge housing 32 or to the hinge sleeve of the hinge lever 29 which surrounds the hinge pin 31. The other partially rolled end 35 of the leaf spring 33 is fastened to or suspended on a sleeve 36 which is held between the arms 22 and 23 of the hinge arm 1 by means of a pin 37. The arrangement of the sleeve 36 in the hinge arm 1 is such that the leaf spring 33, upon the closing of the cabinet door, i.e. upon the movement of the hingehousing 32 in the direction indicated by the arrow D, is first of all deformed in the direction of lesser curvature in order to increase the spring force acting between the sleeve 36 and the hinge pin 31 or between the hinge arm 1 and the hinge housing 32, and then relaxes again, as a result of which the cabinet door as well as the hinge housing 32 are pressed automatically by the relaxing spring 33 into the closed position and held fast therein. The leaf spring 33 preferably consists of spring steel, but may however also be made of flexible plastic.

In order to obtain by means of the leaf spring 33 sufficient force to hold the cabinet door in closed position and to assure dependable operation of the hinge, i.e. in particular also a sufficient anchoring of the leaf spring on the sleeve 36 or on the hinge sleeve surrounding the hinge pin 31 of the hinge lever 29, it is necessary to pretension the leaf spring 33 in such a manner that it is not completely relaxed in any position of the hinge. In particular, the leaf spring 33 must still have a certain tension even in those positions of the hinge in which the least tension is present in the leaf spring (for instance, hinge-open position). The sleeve 36 serves to facilitate the mounting of the pretensioned leaf spring 33. For this purpose the sleeve 36 has on each of its ends a section (collar) 38 whose cross section is greater than the rest of the cross section of the sleeve 36. The leaf spring 33 has its end 35 lying between the sections 38. The diameter of the sections 38 is such that the sleeve 36 rests by means of the sections 38, when the pin 37 is still not mounted but the leaf spring 33 has been placed on, against the hinge sleeve of the hinge lever 29 which surrounds the hinge pin 27 on the hinge-arm side. In this way the sleeve 36 finds support, even if the leaf spring 33 is only slightly tensioned until the final mounting of the pin 37, the inner bore 39 of the sleeve 36 being displaced only slightly with respect to the bearing holes 40 and 41 which are provided in the sides 22 and 23 of the hinge arm for the pin 37 (see FIG. 5). The partial overlapping of the bearing holes 40 and 41 with the inner bore 39 of the sleeve 36 is achieved in the manner that the difference between the distances between the bearing holes 40 and 41 and the hinge sleeve of the hinge lever 39 surrounding the hinge pin 37 and between the inner bore 39 and the circumferential surface of the section 38 is less than the diameter of the bearing holes 40 and 41 or of the inner bore 39.

Figure 5:
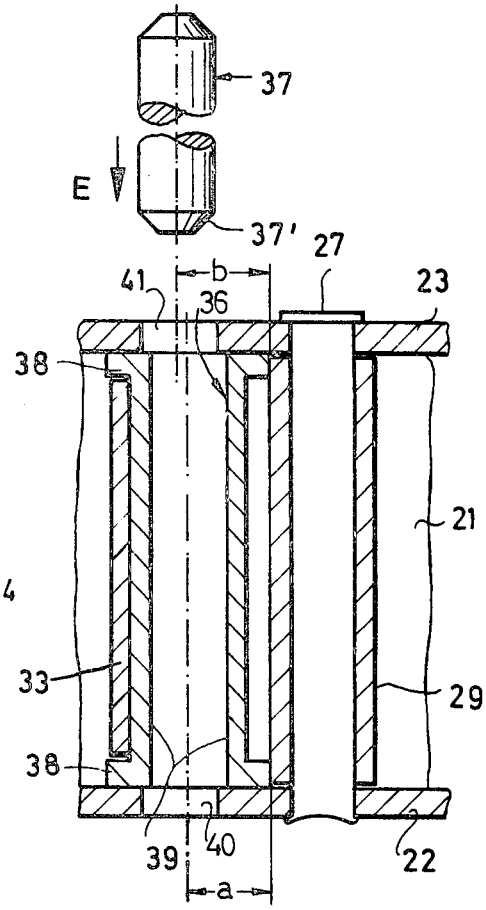
FIG. 5 is a section along the line I—I of FIG. 3.

In the position shown in FIG. 5, which the sleeve 36 and the hinge arm 1 have with respect to each other, it is then possible without difficulty to push the pin 37 in the direction of the arrow E from the side through the bearing bore 41 in the side 23 into the inner bore of the sleeve, the sleeve 36 being pushed by the tapered end 37' of the pin 37 so far to the side away from the hinge pin 27 that the inner bore 39 is aligned with the bearing holes 40 and 41 and the end of the pin 37 provided with the taper 37' can be pushed through the sleeve 36 into the second bearing borehole 40 in the side 22. In the embodiment shown, the length of the sleeve 36 is furthermore selected equal to the distance of the sides 22 and 23 from each other so that upon the introduction of the pin 37 through the bearing hole 41 into the inner bore 39 the sleeve 36 cannot become askew and thus the entrance of the pin 37 into the bearing borehole 40 is also assured. Since, after the insertion of the pin 37, the bearing boreholes 40 and 41 are aligned with the inner borehole 39, the sleeve 36 is displaced to the side to such an extent away from the hinge sleeve which surrounds the hinge pin 27 that the hinge lever 29 upon swinging does not rub against the sections 38 of the sleeve and furthermore the leaf spring 33 is additionally tensioned.

After the insertion of the pin 37, it is anchored in the customary manner at both ends into the sides 22 and 23 of the hinge arm, for instance by clinching.

For the fastening of the hinge to the cabinet side wall 4, fastening screws 42 are first of all inserted into the boreholes 43 and 44 which are provided on the intermediate carrier on both sides of the extension 5. Thereupon, the bearing element 3 is placed on the intermediate carrier 2 in such a manner that the intermediate carrier 2 lies between the legs 8 and 9 of the bearing element and the extension 5 engages into the recess 10. By introducing the screw 13 into the slot 14 and by turning the screw into the thread 16 the bearing element is then secured on the intermediate carrier 2, the fastening screws 42 remaining accessible to a screwdriver through the boreholes 45 and 46 in the bearing element. The base or adjustment plate which consists of the intermediate carrier 2 and the bearing element 3 can be delivered in this condition from the hardware manufacturer to the customer, for instance to a cabinet manufacturer, who then fastens the base or adjustment plate to the side wall 4 of the cabinet by means of the fastening screws 42, as shown in FIG. 3.

Thereupon, the holding screw 19 is turned into the thread 18 to an extent such that said holding screw still protrudes sufficiently beyond the bearing element 3. The tightening of the holding screw 19 can in this connection of course also be effected by the hardware or hinge manufacturer. For the final mounting of the hinge on the side wall 4 of the cabinet the hinge arm 1, which is premounted with all necessary hinge parts, is placed on the base or adjustment plate, for which purpose the head of the holding screw 19 is first of all passed through the cross sectional portion of greater width of the keyhole-shaped recess 20 of the hinge arm 1 and the hinge arm 1 is pushed relative to the bearing element 3 in such a manner that the holding screw 19 is finally located in the region of smaller cross section of the recess 20 and the head of the screw 19 rests against the top of the yoke surface 21 of the hinge arm 1. Before the holding screw 19 is finally tightened, the hinge arm is adjusted in the direction of the double-ended arrows B and C by means of the adjustment screws 25 and by longitudinal displacement of the hinge arm relative to the bearing element 3, in known manner.

Even after the placing of the hinge arm 1 on the bearing element 3, the screw 13 is still accessible for a screw-driver through the region of larger cross section of the key-hole-shaped recess 20 so that after possible adjustment of the hinge arm in the third axis in space, i.e. after displacement of the bearing element 3 relative to the intermediate carrier 4 in the direction indicated by the arrow A, the screw 13 can be tightened. Since the width of the extension 5 in the direction of the double-ended arrow B is slightly greater than the corresponding width of the recess 10, the extension 5 is wedged tightly in the recess 10 by this tightening of the screw 13, so that after the tightening of the screw 13 a dependable anchoring between the intermediate carrier 2 and the bearing element 3 is assured.

The intermediate carrier 2 as well as the bearing element are made, for instance, of plastic. However, it is also possible merely to make the intermediate carrier 2 of plastic and to use metal for the bearing element 3.

Furthermore, instead of the leaf spring 33 there can also be used a spring of different design, made of metal or an elastic material.

What is claimed is:

1. In the furniture hinge for the articulated connection of two furniture components, said higne having a first hinge part means operable for attachment to a first of said furniture components and a second hinge part means operable for attachment to the second of said furniture components, articulation means connecting said first and second hinge part means, said articulation means including a plurality of hinge lever means connected at their respective ends to said hinge part means by hinge pins and a spring element urging said first and second hinge part means toward one position, the improvement comprising a spring retaining pin, a bearing sleeve having inside diameter operable to receive said pin and an outside surface operable to receive one end of said spring element, a pair of parallel walls defined in the first of said hinge part means and operable to receive therein between said bearing sleeve, said walls having aligned boreholes operable to permit insertion of said pin into said bearing sleeve, and resting surface means disposed within the walls of said first hinge part means, said resting surface means being operable upon the urging of said spring element to position said sleeve so that its inside diameter overlaps but is slightly displaced from said wall boreholes, said bearing sleeve being displaced from said resting surface means into alignment with said wall boreholes with a concurrent tensioning of said spring element upon insertion of said pin into said bearing sleeve.

2. A hinge according to claim 1 wherein the spring element is a leaf spring.

3. A hinge according to claim 2 wherein the bearing sleeve has a first portion of lesser outside cross section for receiving said leaf spring and an outer portion of greater cross section for engaging said resting surface.

4. A hinge according to claim 1 wherein the resting surface is comprised in separate hinge lever means.

5. A hinge according to claim 3 having portions of greater cross section at each end of the bearing sleever.

6. A hinge according to claim 1 wherein said first hinge part is a hinge arm of U-shaped cross section.

7. A hinge according to claim 6, wherein the length of the bearing sleeve corresponds approximately to the distance between the walls of the U-shaped hinge arm.

* * * * *